US005321476A

United States Patent [19]

Gross

[11] Patent Number: 5,321,476

[45] Date of Patent: Jun. 14, 1994

[54] HEATED BIAS TRANSFER ROLL

[75] Inventor: Robert A. Gross, Penfield, N.Y.

[73] Assignee: Xerox Corporation, Stamford, Conn.

[21] Appl. No.: 961,581

[22] Filed: Oct. 15, 1992

[51] Int. Cl.[5] ..... G03G 15/16

[52] U.S. Cl. ..... 355/271; 355/279

[58] Field of Search ..... 355/279, 271, 208, 274; 430/126

[56] References Cited

U.S. PATENT DOCUMENTS 3,954,332 5/1976 Fisher .
3,954,333 5/1976 Goel .
4,062,812 12/1977 Safford et al. ..... 252/500
4,116,894 9/1978 Lentz et al. ..... 521/94
5,156,915 10/1992 Wilson et al. ..... 355/274 X

*Primary Examiner*—R. L. Moses
*Attorney, Agent, or Firm*—Denis A. Robitaille

[57] ABSTRACT

A bias transfer member including an internal heating element is disclosed. The transfer member includes a thermocouple or voltage activated switch for allowing current flow through the heating element in response to predetermined conditions to raise the temperature of the transfer member and thereby decrease and maintain a substantially constant resistivity in the transfer member so as to extend the electrical life of the transfer member.

14 Claims, 5 Drawing Sheets

HEATED BIAS TRANSFER ROLL

The present invention relates generally to a system for transfer of charged toner particles in an electrostatographic printing apparatus, and more particularly concerns an electrically biased contact transfer member including a heating element for applying heat to the transfer member.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface thereof. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, digital laser printing or ionographic printing and reproduction where charge is deposited on a charge retentive surface in response to electronically generated or stored images.

The operation of transferring developing material from the photoreceptive member to the image support substrate is realized at a transfer station. In a conventional transfer station, transfer is achieved by applying electrostatic force fields in a transfer nip sufficient to overcome forces holding the toner particles to an original support surface on the photoreceptive member. These electrostatic force fields operate to attract and transfer the toner particles over onto the copy sheet or other support surface.

Typically, transfer of toner images between support surfaces in electrostatographic applications is accomplished via electrostatic induction using a corotron or other corona generating device. In such corona induced transfer systems, the final support sheet or other image support substrate is placed in direct contact with the toner image while the image is supported on the photoconductive surface. Transfer is induced by spraying the back of the support sheet with a corona discharge having a polarity opposite that of the toner particles, thereby electrostatically transferring the toner particles to the sheet. An exemplary corotron ion emission transfer system is disclosed in U.S. Pat. No. 2,836,725.

Biased roll transfer systems have also been used successfully to accomplish toner transfer. This type of transfer was first disclosed by Fitch in U.S. Pat. No. 2,807,233 which disclosed the use of a metal roll coated with a resilient coating having an approximate resistivity of at least $10^6$ ohm-cm, providing a means for controlling the magnetic and non-magnetic forces acting on the toner during transfer. One shortcoming in such bias roll transfer systems arises because the resistivity of the resilient coating introduces a limit to the amount of bias that can be applied to the roll due to the fact that, at higher ranges, the air in and about the transfer zone begins to break down, or "ionizes", causing the image to degrade during transfer. Nonetheless, bias roll transfer has become the transfer method of choice in many state-of-the-art xerographic copying systems and apparatus. Notable examples of biased roll transfer systems are described in U.S. Pat. No. 3,702,482 by C. Dolcimascolo et al., and U.S. Pat. No. 3,781,105, issued to T. Meagher. Other general examples of biased roll transfer systems can be found in U.S. Pat. Nos. 3,043,684; 3,267,840; 3,328,193; 3,598,580; 3,625,146; 3,630,591; 3,684,364; 3,691,993; 3,832,055; and 3,847,478.

As described, the process of transferring development materials in an electrostatographic system involves the physical detachment and transfer-over of charged particulate toner materials from one surface into attachment with a second surface via electrostatic force fields. The critical aspect of the transfer process focuses on maintaining the same pattern and intensity of electrostatic fields as on the original latent electrostatic image being reproduced to induce transfer without scattering or smearing of the developer material. This difficult requirement is met by careful control of the electrostatic fields which, by necessity, must be high enough to effect toner transfer while being low enough so as not to cause arcing or excessive ionization at undesired locations. Such electrical disturbances can create copy or print defects by inhibiting toner transfer or by inducing uncontrolled transfer of the development materials.

The problems associated with successful image transfer are well known. In the pre-transfer air gap region or the so called pre-nip region, immediately in advance of copy sheet contact with the image, excessively high transfer fields can result in premature transfer across the air gap, leading to decreased resolution or blurred images. High transfer fields in the pre-nip air gap can also cause ionization which may lead to loss of transfer efficiency, strobing or other image defects, and a lower latitude of system operating parameters. Conversely, in the post-transfer air gap region or the so called post-nip region, at the photoconductor/copy sheet separation area, insufficient transfer fields can cause image dropout and may generate hollow characters. Improper ionization in the post-nip region may also create image stability defects or cause copy sheet detacking problems. The overriding consideration in providing an effective transfer system centers on the fact that the transfer field should be as large as possible in the region directly adjacent the transfer nip where the copy paper contacts the image so that high transfer efficiency and stable transfer can be achieved.

Variations in ambient environment conditions, copy paper resistivity, contaminants, and field strength, can all effect necessary transfer parameters. Material resistivity can change greatly with humidity and other environmental parameters. Further, in bias transfer roll systems, conduction of the bias charge from the bias transfer roll is greatly affected by the magnitude of transfer current through, as well as the resistivity of the material of the bias roll. Moreover, the functional life of the bias transfer roll is directly related to maintaining a constant controlled resistivity of the coating through which the transfer current flows.

It has been shown that charge control additives such as organic salts and specifically tetrahepthlammonium bromide (THAB) can be used in bias transfer system components to attain specific resistivity levels (U.S. Pat. Nos. 4,062,812; 4,116,894). However, as transfer current flows through the biased transfer member, the charge control additives in the base material thereof tend to migrate toward the biasing source, thereby depleting ions in the base material and increasing the resistivity of the material. Resistivity also increases as a function of relative humidity and temperature This causes the bias voltage across the roll to increase in response to constant transfer current applied thereto. As a result, the pre-nip fields increase correspondingly, generating severe copy quality problems. Resultant increased voltages also complicate hardware design and add to the expense of the system.

Thus, a problem associated with bias transfer roll systems is that the electrical life of the bias roll material is inversely proportional to the transfer current therethrough. Various approaches and solutions to the problems inherent to the use of bias transfer rolls and specifically directed toward extending the electrical life thereof have been proposed. The following disclosures may be relevant to various aspects of the present invention:

U.S. Pat. No. 4,062,812.
Patentee: Safford et al.
Issued: Dec. 13, 1977.

U.S. Pat. No. 4,116,894.
Patentee: Lentz et al.
Issued: Sep. 26, 1978.

JP-A-2-39182.
Patentee: Koichi Okuda et al.
Issued: Feb. 8, 1990.

U.S. patent application Ser. No. 07/789,506.
Inventor: Gross et al.
Filed: Nov. 8, 1991.

U.S. patent application Ser. No. 07/801,568.
Inventor: Gross
Filed: Dec. 2, 1991.

The relevant portions of the foregoing disclosures may be briefly summarized as follows:

U.S. Pat. No. 4,062,812 discloses a method for extending the electrical life of copolymers used in bias transfer rolls. That patent recognizes that control of, and minimization of the variations in the resistivity under applied voltages with respect to time is important. Thus, certain salts having a particular geometric make-up which are useful for extending the functional electrical life and electrical stability of materials are incorporated into the materials used in xerographic devices.

U.S. Pat. No. 4,116,894 also discloses compositions and a method for enhancing the electrical life of copolymers used in xerographic devices. That patent discloses a specific method for enhancing the electrical life of butadiene copolymers having solublized conductivity control agents incorporated therein by varying specified quantities of terminally unsaturated hydrocarboned nitriles in the butadiene.

JP-A-2-39182 discloses an image forming device utilizing a bias transfer roller for impressing a transfer bias when a paper is fed into a transfer nip. A transfer bias lower than the bias applied during transfer but having a polarity opposite the polarity of the toner is impressed when paper is not fed into the transfer nip so as to prevent paper trace or back trace to a transfer member.

U.S. patent application Ser. No. 07/789,506 is directed toward a method and apparatus for extending material life in a biased transfer roll by enabling reverse current flow therethrough. The apparatus of that invention includes a biasing member including a bias roll or other charging device for reversing current flow through the bias transfer roll.

U.S. patent application Ser. No. 07/801,568 is directed toward a system for extending the electrical life of a bias transfer member including a switching device for selectively coupling the bias transfer member to an electrical biasing source for either permitting current flow through the bias transfer member to induce toner transfer or inhibiting or reversing current flow through the bias transfer member to replenish ions depleted therefrom.

In accordance with the present invention, a transfer apparatus for electrostatically transferring electrically charged particles from an image support surface to a copy support substrate is disclosed, comprising a transfer member positioned adjacent the image support surface, biasing means coupled to the transfer member for applying an electrical bias to the transfer member to generate electric fields, thereby attracting toner particles from the image support surface to the copy substrate, and means for maintaining the transfer member at a substantially constant resistivity.

In another aspect of the invention, an electrostatographic printing apparatus is disclosed, including a transfer assembly for transferring toner particles from a photoconductive image support surface to a copy support substrate, wherein the transfer assembly includes a transfer member positioned adjacent the image support surface, biasing means coupled to the transfer member for applying an electrical bias thereto, generating electric fields to attract the toner particles from the image surface to the copy substrate, and means for maintaining the transfer member at a substantially constant resistivity.

These and other aspects of the present invention will become apparent from the following description in conjunction with the accompanying drawings, in which.

Figure 1:
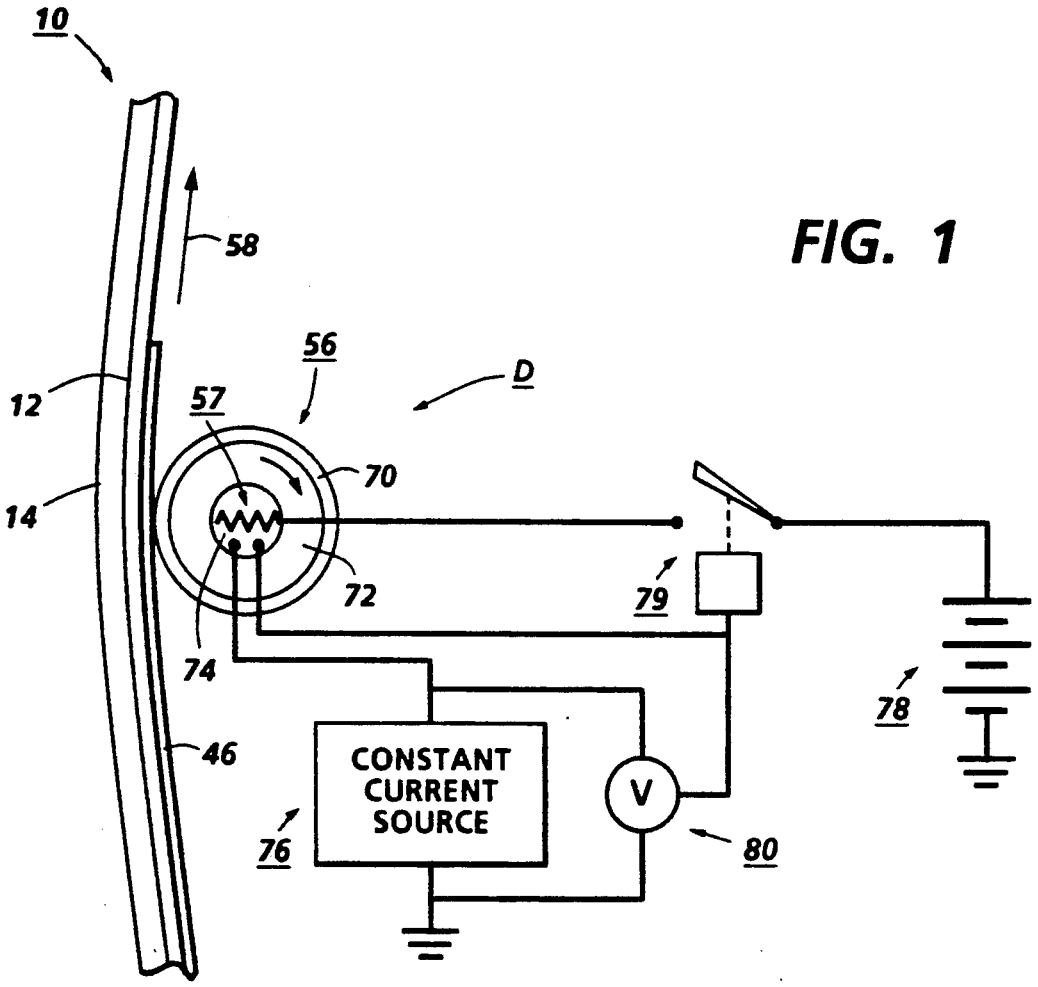
FIG. 1 is a side view of one preferred embodiment of the transfer apparatus of the present invention showing a bias transfer roll having a heating element embedded therein.

While the present invention will be described with reference to preferred embodiments thereof, it will understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements.

Figure 3:
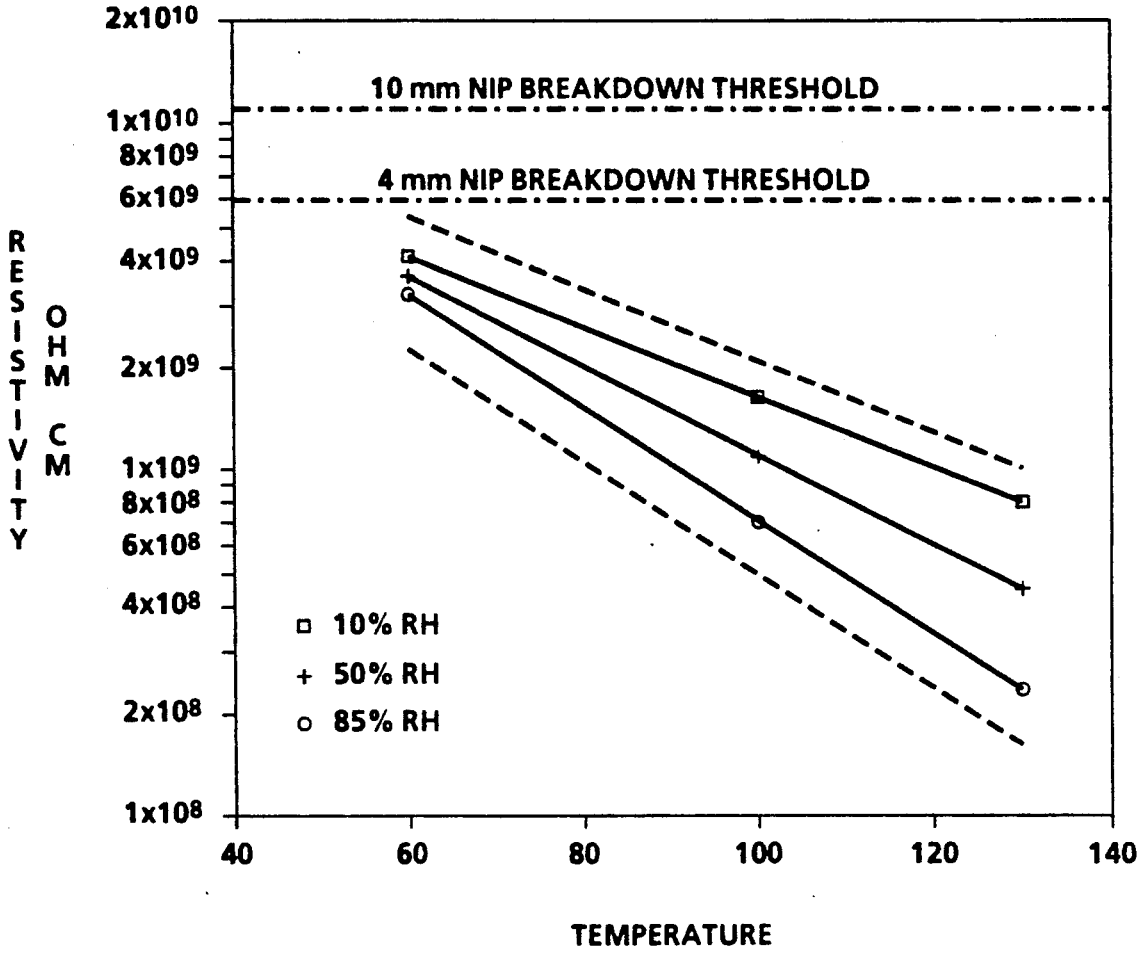
FIG. 3 shows a graphical representation of bias transfer roll resistivity with respect to temperature and relative humidity.

For a general understanding of an electrostatographic printing machine in which the features of the present invention may be incorporated, reference is initially made to FIG. 3, before providing a description of the specific features of the present invention, wherein a schematic depiction of the various components of an exemplary electrophotographic reproducing apparatus incorporating the transfer assembly of the present invention is provided. Although the apparatus of the present invention is particularly well adapted for use in an automatic electrophotographic reproducing machine as shown, it will become apparent from the following discussion that the present transfer assembly is equally well suited for use in a wide variety of electrostatographic processing machines as well as in any other system utilizing a bias transfer device. Further, the invention is not necessarily limited in its application to the particular embodiment or embodiments shown herein.

Figure 5:
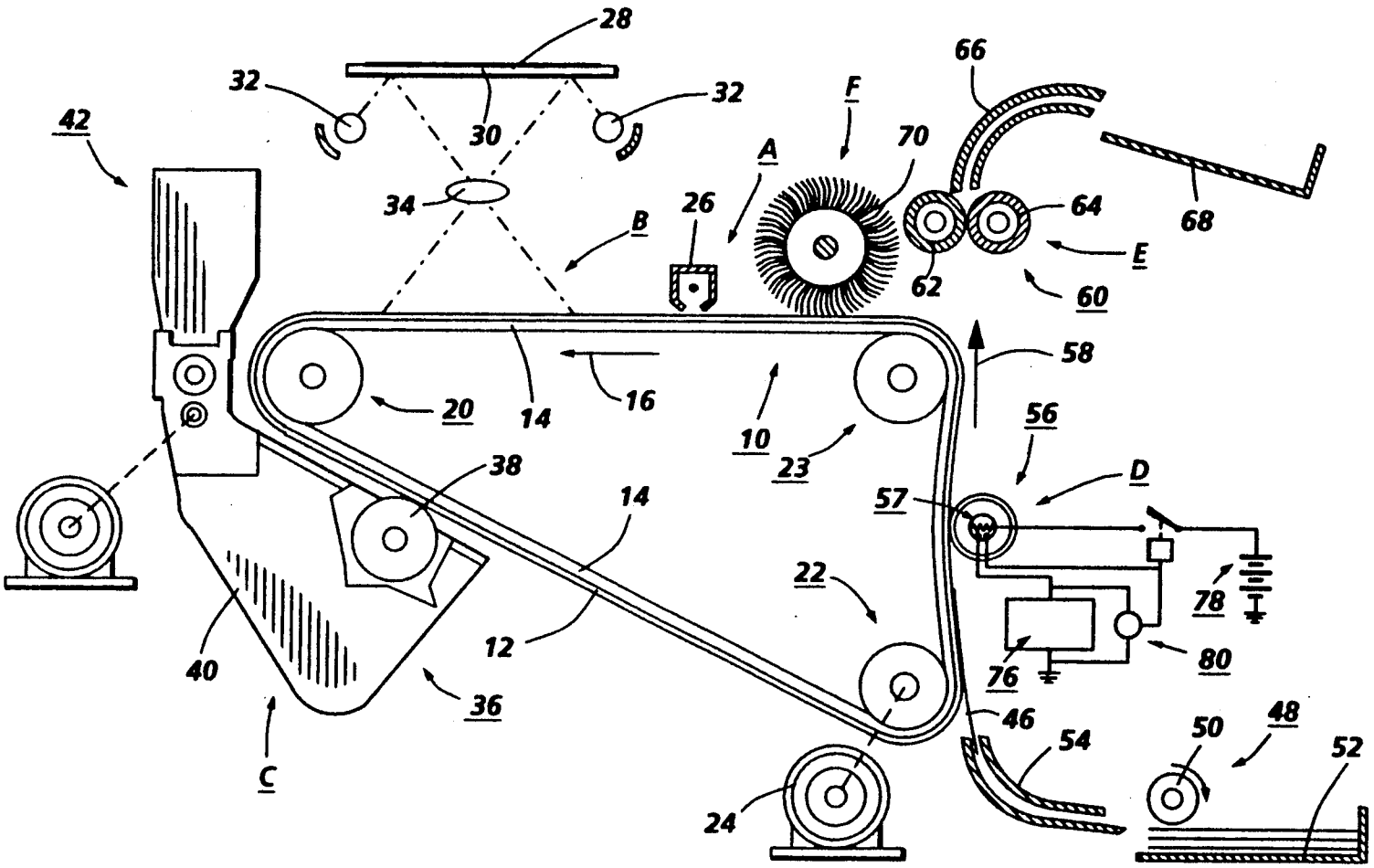
FIG. 5 is a schematic elevational view showing an electrostatographic printing machine employing the features of the present invention.

The exemplary electrophotographic reproducing apparatus of FIG. 5 employs a belt 10 including a photoconductive surface 12 deposited on an electrically grounded conductive substrate 14. Drive roller 22, coupled to motor 24 by any suitable means, as for example a drive belt, engages with belt 10 to move belt 10 about a curvilinear path defined by drive roller 22, and rotatably mounted tension rollers 20, 23. This system of rollers is used for advancing successive portions of photoconductive surface 12 in the direction of arrow 16, through various processing stations disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from this light source are reflected from the original document 28 to form a light image thereof for transmission through a lens 34 which focuses the light image onto the charged portion of photoconductive surface 12, This imaging process selectively dissipates the charge on the photoconductive surface 12 and records an electrostatic latent image corresponding to the original document 28 onto photoconductive surface 12. Although an optical system has been shown and described for forming the light image of the information used to selectively discharge the charged photoconductive surface 12, one skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, belt 10 advances to development station C where a magnetic brush development system, indicated generally by reference numeral 36, deposits developing material onto the electrostatic latent image. Preferably, magnetic brush development system 36 includes a single develop roller 38 disposed in developer housing 40, wherein toner particles are mixed with carrier beads, generating an electrostatic charge therebetween which causes the toner particles to cling to the carrier beads to form developing material. The developer roller 38 rotates and attracts this developing material to form a magnetic brush having carrier beads and toner particles magnetically attached thereto. Thus, as the developer roller 38 rotates, developing material is brought into contact with the photoconductive surface 12 such that the latent image thereon attracts the toner particles of the developing material and the latent image on photoconductive surface 12 is developed into a visible image. A toner particle dispenser, indicated generally by the reference numeral 42, furnishes a supply of additional toner particles to housing 40 to sustain the developing process.

After the toner particles have been deposited onto the electrostatic latent image for development thereof, belt 10 advances the developed image to transfer station D, where a sheet of support material 46 is moved into contact with the developed toner image via sheet feeding apparatus 48 and chute 54. Preferably, sheet feeding apparatus 48 includes a feed roller 50 for rotation while in contact with the uppermost sheet of stack 52 to advance the uppermost sheet into chute 54. Chute 54 directs the advancing sheet of support material 46 into contact with photoconductive surface 12 of belt 10 in a timed sequence so that the developed image thereon contacts the advancing sheet of support material 46 and is transferred thereon at transfer station D. A bias transfer roll 56 is provided for establishing a directional force field capable of attracting toner particles from the photoconductive surface 12 to support material 46. The support material 46 is subsequently transported in the direction of arrow 58 for placement onto a conveyor (not shown) which advances the sheet to a fusing station E.

Fusing station E includes a fuser assembly, indicated generally by the reference numeral 60, for permanently affixing the transferred image to sheet 46. Fuser assembly 60 preferably comprises a heated fuser roller 62 and a support roller 64 spaced relative to one another for receiving a sheet of support material 46 therebetween. The toner image is thereby forced into contact with the support material 46 between fuser rollers 62 and 64 to permanently affix the toner image to support material 46. After fusing, chute 66 directs the advancing sheet of support material 46 to receiving tray 68 for subsequent removal of the finished copy by an operator.

Invariably, after the support material 46 is separated from the photoconductive surface 12 of belt 10, some residual developing material remains adhered to belt 10. Thus, a final processing station, namely cleaning station F, is provided for removing residual toner particles from photoconductive surface 12, subsequent to separation of the support material 46 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for purposes of the present application for patent to illustrate the general operation of an electrophotographic reproducing apparatus incorporating the features of the present invention. As described, the electrophotographic reproducing apparatus may take the form of any of several well known devices or systems. Variations of specific electrostatographic processing subsystems or processes may be expected without affecting the operation of the present invention.

Referring now in particular to FIG. 1, a particular embodiment of the bias transfer assembly in accordance with the present invention will be described. The use of the term "bias transfer roll" or "bias transfer assembly" refers to a transfer assembly having an electrically biased contact member for cooperating with an image support surface to attract electrically charged particles from the image support surface onto a second support surface, such as a copy sheet or the like. Specifically, a bias transfer assembly including a bias transfer roll is shown in FIG. 1, wherein the bias transfer roll 56 is shown in a configuration adapted to form a transfer nip for receiving the copy substrate 46, which allows the copy substrate 46 to cooperate, in conjunction with the bias transfer roll 56, with a toner image on the photoconductive surface 12 of belt 10 when brought into contact therewith. The bias transfer roll 56 electrically attracts charged toner particles from the photoconductive surface 12 in the direction of the bias transfer roll 56 so as to transfer the developed images on the photoconductive surface from the belt 10 to the copy substrate 46 positioned therebetween.

For the purposes of the present discussion, a configuration is shown wherein the bias transfer roll 56 is urged physically against belt 10, forming a nip therebetween and having no opposing support member thereagainst, such that the bias transfer roll 56 causes the path of belt 10 to be slightly bowed, thereby increasing the contact dwell time between the belt 10 and the bias transfer roll 56. It will be understood, however, that a backup roll (not shown) may be provided opposite the transfer roll 56 for urging the belt 10 into contact with the transfer roll 56 with minimal or no distortion in the path of belt 10. For example, the transfer station D can be positioned adjacent drive roll 23 (FIG. 3), or an independent roll may be added to the system configuration along the path of belt 10, opposite the transfer roll 56. Alternatively, the bias transfer roll system can be integrated into a machine having a drum type photoreceptor. The bias transfer roll 56 is appropriately journaled for rotation at an angular velocity so that the peripheral speed of the roll 56 is substantially equal to the speed of the belt 10. The arrows shown in FIG. 1 indicate the relative direction of movement for the copy substrate 46, the transfer roll 56 and belt 10, as the copy support substrate 46 is fed by appropriate means into the nip formed between transfer roll 56 and belt 10. As such, the terms "pre-nip" and "post-nip" used herein, refer to the direction of travel of the copy substrate 46 through the transfer nip.

The exemplary transfer roll 56 of the present invention includes an electrically "self-leveling" outer layer 70, and an electrically "relaxable" inner layer 72 on an electrically conductive central core or axle 74. Thicknesses of the various layers shown are provided for illustrative purposes only and are not necessarily drawn to scale. An electrical biasing device in the form of a constant current source 76 is electrically coupled to the conductive core 74 for providing an electrical bias thereto. An internal heating element 57 is also provided for maintaining the temperature of the bias transfer roll 56, and, more specifically, the resistivity of the electrically conductive inner and outer layers 70, 72 at a predetermined level.

In a preferred embodiment, the relaxable layer 72 of the transfer roll 56 is comprised of a relatively thick blanket of a resilient elastomeric polyurethane material, which may include a butadiene based copolymer having a hardness of between about 40 Shore 00 and about 90 Shore A. This elastomeric polyurethane blanket may be about 0.030 to about 0.625 inches in thickness (preferably 0.25 inches in thickness), and may have sufficient resiliency to allow the bias transfer roll 56 to deform when brought into moving contact with an opposingly supported portion of belt 10. The relative deformable characteristics of the relaxable layer 72 as well as the belt 10 allow for good mechanical contact in the transfer zone at moderate pressures to eliminate "hollow character" transfer under normal operating conditions. This deformable feature also provides an extended contact region for increasing the dwell time in which toner particles of the developer material can be transferred between support surfaces. It will be understood that the deformable feature provided by relaxable layer 72 is not a necessary feature of the present invention, as for example in a configuration, as shown, wherein transfer is conducted against an unsupported portion of belt 10.

The material making up the relaxable layer 72 is further selected so that it functionally takes a selected time period to transmit a charge from the conductive inner core 74 to the interface between the relaxable layer 72 and the self-leveling layer 70. The relaxable layer 72 has a bulk resistivity failing in a well-defined operating range selected relative to the diameter of the transfer roll 56 and the surface velocity thereof. The preferred resistivity ranges may vary for transfer systems designed to operate at different transfer sheet throughput speeds. This selected resistivity corresponds to the roller surface speed and nip region dimension such that the time necessary to transmit a charge from the conductive core 74 to the self-leveling layer 70 is roughly greater than the dwell time for any point on the transfer roll 56 in the transfer nip region. Ideally, the external voltage profile of the bias transfer roll 56 provides a field strength below that is necessary for substantial air ionization in the air gap at the entrance of the nip, and above that required for air ionization in the air gap just beyond the exit of the nip. As a general rule, the magnitude of the external electric field increases significantly from the pre-nip entrance toward the post-nip exit while the field within the relaxable layer 72 diminishes. It has been found that a resistivity of between about $10^7$ and $5.0\times10^{11}$ ohm-cm, and preferably a resistivity of about $10^8$ to about $10^{10}$ ohm-cm is sufficient for this requirement.

The transfer roll 56 is covered with a relatively thin external coating, so called self-leveling layer 70, which may comprise an elastomeric material such as polyurethane having a resistivity of between $10^{10}$ and $10^{15}$ ohm-cm, preferably having a thickness of approximately 0.0025 inches and a hardness of about 65 to 75 Durometer. The material of the self-leveling layer is generally selected for its higher resistive values, providing a so-called leaky insulator. In addition, the self-leveling layer includes material (or is so related to the relaxable layer) so that charges applied to the outer surface of the self-leveling layer 70 will be generally dissipated within one revolution of the transfer roll 56 in order to prevent suppression of the transfer fields in the transfer nip. The self-leveling layer 70 also acts as a thin insulating layer to protect the bias transfer roll 56 during air breakdown and to limit current flow through the roll 56. In addition, an external coating having increased hardness provides a moisture barrier for the inner components of the roll 56 and makes the roll structure easy to clean. It will be noted, however, that other materials which are resilient, durable and cleanable have been used to form the relaxable layer 72, such that the self-leveling layer 70 described herein is not essential to the functionality of the bias transfer roll.

Electrical biasing source 76 is provided for generating current flow through the bias transfer roll 56. The biasing source 76 provides a constant current source for creating high transfer fields while maintaining pre-nip ionization at tolerable levels and allowing a desired amount of post-nip ionization. A discussion of the electric fields developed by the bias transfer roll 56 and the roles of the relaxable and self-leveling layers, as well as a detailed description of a preferable circuit for the electrical biasing source 76 are provided in U.S. Pat. No. 3,781,105, issued to Meagher, the contents of which are hereby incorporated by reference.

The functional life of a bias transfer contact member, such as a bias transfer roll, is directly related to the maintenance of a constant controlled resistivity region. However, most ionic additives utilized for reducing the resistivity in polymer materials used in bias transfer roll members migrate toward higher potential energy, causing an increase in ionic mobility which therefore results in a more rapid variation in resistivity over the life of the material. It is known that the electrical life of materials used in bias transfer devices and subsystems as described above can be improved by controlling and maintaining constant resistivity with time under an applied electrical field. It is also known that resistivity of a material is directly related to the temperature thereof. Thus, it has been found by the present invention, that electrical life of a bias transfer member can be improved by selectively applying heat to the bias transfer member for maintaining the temperature thereof at a predetermined elevated temperature. Variation of the temperature of the bias transfer roll allows for control of the resistivity thereof. For this reason, the present invention provides a resistive heating element 57 internal to the conductive core 74 of the bias transfer roll 56 for controlling the temperature thereof.

The operation of roller 57 may be explained in connection with the generalized curves in FIG. 2. The time scale along the horizontal axis represents the movement of the copy sheet 46 through the nip region. The pre-nip period is to the left of the nip transfer period 62, and the post-nip period is to the right of transfer nip period 43. Since velocities are assumed constant here the horizontal axis also corresponds to path distances relative to the transfer nip area.

Figure 2:
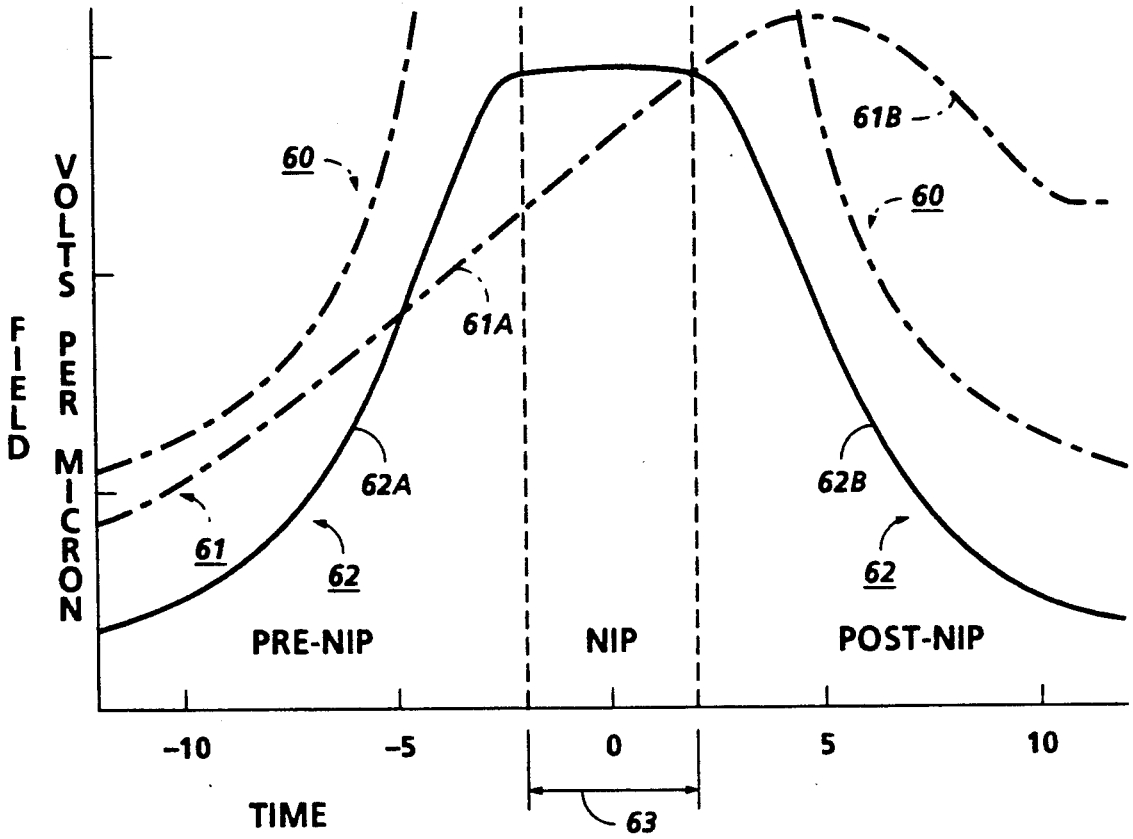
FIG. 2 shows a graph of electrical field as a function of time in the pre-nip, nip, and post-nip regions.

The volts-per-micron scale along the vertical axis of FIG. 2 represents relative transfer field intensity along the path of the transfer sheet. The field observed is that between the outer surface of the roller 57 and the photoreceptive surface 12 of belt 10. It is that field which effects the transfer of the toner particles between the photoreceptor belt 10 and the copy sheet 46.

Curve 60 in FIG. 2 is the Paschen curve which represents the field intensities at or above which ionization of air will normally occur (on both sides of the nip). Curve 61 is the transfer field curve generated by the roller transfer system of FIG. 1. Curve 62 is an exemplary curve for a typical bias transfer roll, e.g., conductive rollers and conductive rollers overcoated with high resistance and/or high dielectric materials. Curve 62 is shown in order to comparatively dramatize the desirable asymmetrical nature of the subject curve 61, which permits post-nip, but minimizes pre-nip, ionization of air.

Curve 62 represents a typical approach to bias roll transfer in that the curve 62 is symmetrical about the nip contact region (represented by the time period 63) in the absence of toner and air ionization effects. Conversely, curve 61 is asymmetrical because of the effects of the resistivity control provided by the heating element of the present invention. The object is to maximize the transfer field without having detrimental pre-nip ionization. This is achieved by forcing portion 61B of the curve 61 continue upward in the post-nip region until the Paschen curve is reached while pre-nip portion 61A is selected to remain below the Paschen curve 60 to realize the preferred condition of no pre-nip ionization. In contrast, it is apparent from an inspection of symmetrical curve 62 that the prior art rollers must be biased either above or below the Paschen curve in both pre-nip and post-nip. If they are biased above the Paschen curve, damaging pre-nip ionization accompanies the desired post-nip ionization. If they are biased below, the pre-nip ionization is suppressed, but so is the post-nip ionization such that other means of keeping toner tacked to the copy sheet 46 must be employed in lieu of post-nip ionization.

The transfer conditions depicted by FIG. 2 can be discussed with respect to FIG. 1 wherein it can be seen that prior to entering the nip, the bias transfer roll 56 is not subjected to high internal fields; that is, the outer surface of layer 72 is at substantially the same potential as the core 74. Just prior to and in the nip area the roller surface becomes closely spaced to the photoconductive belt 10 which tends to draw charge toward the roller 56 surface. However, charge movement is resisted by the roller resistivity such that the charge density at the interface between the layers 70 and 72 increases in proportion to the resistivity of the relaxable layer as the relaxable layer proceeds through the nip. After exiting the nip, the charge density will generally continue to increase initially due to the internal field in the relaxable layer 72, or the induced charge may have nearly reached equilibrium; in either case the rapid increase in the air gap soon after separation occurs causes the ionization level to be reached for the field strength corresponding to the residual charge density. (The Paschen curve level at which ionization occurs is a function of spacing as well as field strength, and in the present case it is mainly reached by the increase in the air gap rather than by an increase in the field).

Ions from this air breakdown are drawn to the opposing surfaces of the roller 56 and the copy sheet 46. Then, as the gap becomes substantially wider, the air gap field falls below the Paschen curve, and, as discussed above, charge relaxation occurs in the relaxable layer 72, thereby inhibiting ionization.

The field intensity required to break the bond of toner to the photoreceptor surface 12, and to tack the toner to the copy sheet 46, is reached at some time after the entrance to the nip but before post-nip ionization occurs. However, a continued "holding" or tacking field must also be present during the subsequent stripping of the paper 46 from the photoreceptor belt 10 for high efficiency and stable toner transfer.

With the above information, the significance of the heating element in combination with the constant current energy source is better understood. Stated simply, the significance is that, as previously suggested, the heating element provides the capability to control the resistivity of the bias roll 56 to compensate for changes in the electrical parameters of the roller and its environment. The parameter that normally experiences the greatest and most frequent fluxuations are roller resistivity, which is very sensitive to RH, and temperature. In terms of FIG. 2, temperature control is the method and means for keeping curve portion 61A below the Paschen curve 60 to prevent pre-nip ionization and for insuring that curve portion 61B intersects the Paschen curve in the post-nip region. Controlling the extent of post-nip ionization also controls the amount of deposited charge such that the toner "holding" field on the copy sheet 46 is more constant and maintainable at a moderate level, providing good toner holding as well as easier paper stripping. Thus, high transfer efficiency is achieved with a relatively lower applied voltage and charge density on the transfer member. Moreover, since bias roll electrical life is a function of the applied field and therefore the voltage across the bias transfer roll, maintenance of a constant, lower resistivity extends the electrical life of the roll.

The relationship between resistivity and temperature, as well as relative humidity (RH), is shown in graphic form in FIG. 3. It can be seen from this Figure that, for a nominal 10% RH environment, the resistivity of a roll can be decreased from approximately $4.0\times10^9$ ohm-cm to approximately $1.0\times10^9$ ohm-cm by changing the operating temperature of the roll from 60° to 120° F. Resistivity is less and the relative decease in resistivity is even greater at higher RH as can be seen from the graphic representations for 50% RH and 85% RH. The particular test data shown in FIG. 3 provides a representation of mean data within an envelope of minimum to maximum resistivity variation measured over a given sample of bias transfer rolls tested. FIG. 3 also shows the resistivity breakdown thresholds for nominal nip dimensions of 4 mm and 10 mm at 75 microamps.

The current referred to as being held constant throughout this description is the current to the roll core 74. This roll current is, by reason of conservation of charge, basically equal to the post-nip ionization current. (Substantially zero pre-nip current is, of course, one of the desired operating conditions here.) The constant current bias source 76 may be described as a device for automatically widely varying the potential level coupled to roll 56 to automatically compensate for variation in current to the core 74, due to the connected load (resistance) changes, which are due to changes in ambient RH and temperature and aging of materials as well as various other factors tending to effect the pre-nip, nip and post-nip field levels (e.g., paper thickness, charge build-up on the self-leveling layer, etc.). In the specific system described herein, the constant current source output is equal to about 1.5 microamps per inch, where the inch refers to the length of the roller along its axis. Thus an internal roll resistivity on the order discussed with respect to FIG. 3 requires the bias potential at core 22 to vary from about 4 to about 9 KVolts in order to maintain a constant current of 1.5 microamps per inch. Thus, the bias source 76 output voltage varies automatically over this voltage range while providing a constant current signal.

With further reference to FIG. 1 and in accordance with the present invention, the heating element 57 is coupled to a voltage source 78 via a detecting system such as a thermocouple switch 79 for selectively activating the heating element in response to a detected temperature at the bias transfer roll to maintain a constant predetermined temperature within the bias transfer roll 56. In addition, or alternatively, the detection system can include a voltage measurement device so that the heating element 37 can be selectively activated in response to a predetermined resistivity measurement at the bias transfer member. For example, a voltmeter 80 is provided for monitoring the voltage across the constant current source 76 for maintaining a predetermined constant current through the bias transfer member 56; when the measured voltage exceeds a predetermined voltage level corresponding to a defined resistivity level, the heating element 57 is activated.

Figure 4:
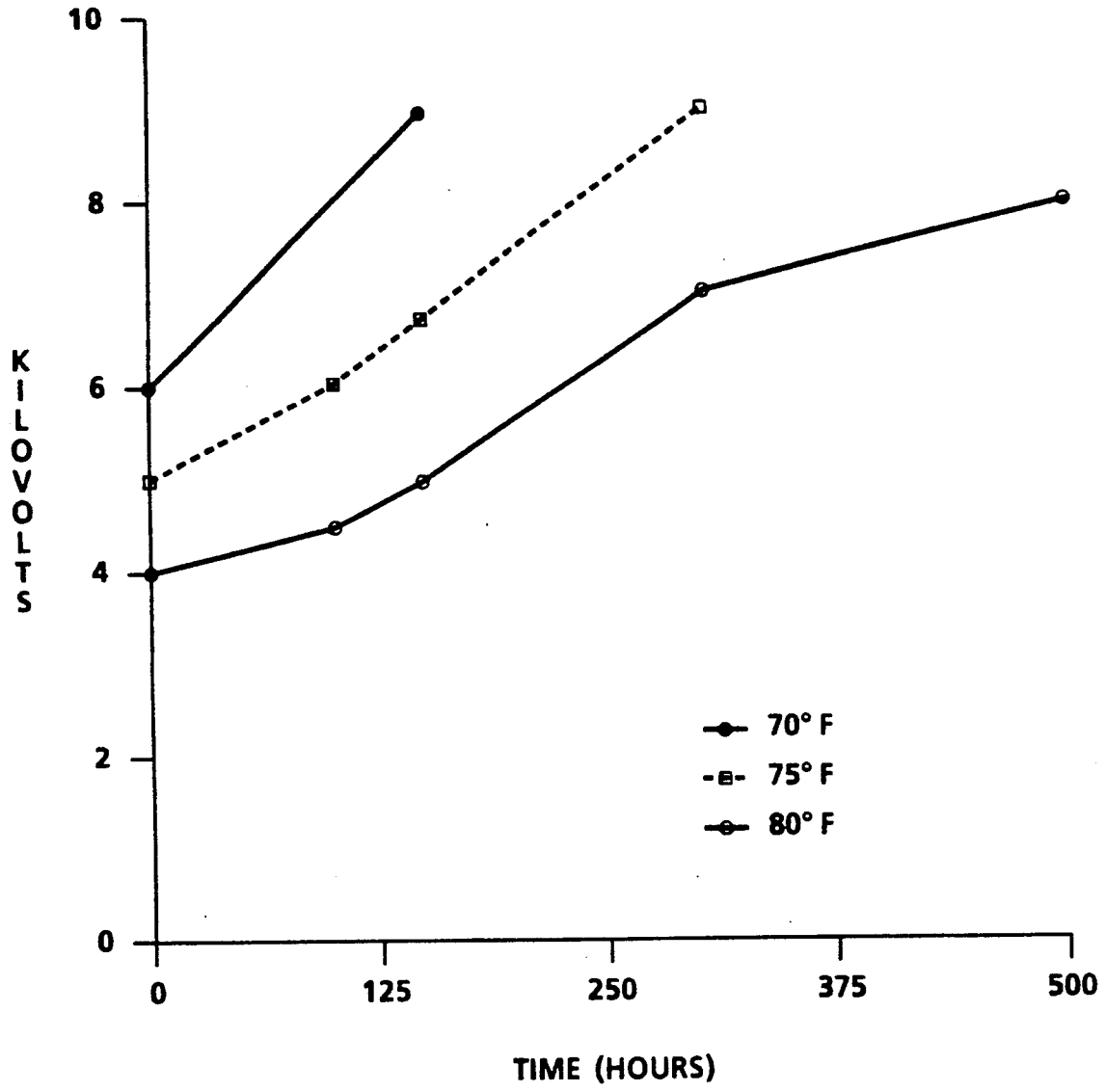
FIG. 4 shows a graphical representation of the bias transfer roll electrical life at constant current with respect to time at various temperatures as provided by the present invention.

Tests have shown that a robust system can be maintained by heating the bias transfer member to approximately 80° F. Such temperature requirements can be satisfied via a relatively low rated, inexpensive heating element. At the stated temperature, the electrical life of the bias transfer member has been shown to be extended by a factor of two. FIG. 4 shows a graphical representation of the bias transfer roll life extension achieved by the present invention when the bias transfer roll 56 is heated to a temperature of approximately 80° F. FIG. 4 shows that as temperature is increased, the voltage across the roll 57 (generated by constant current source 76) decreases, resulting in extended electrical life.

In recapitulation, the electrophotographic printing apparatus of the present invention includes a toner transfer system having a bias transfer roll including an internal resistive heating element for heating the bias transfer roll to a predetermined temperature to reduce and maintain the resistivity of the bias transfer roll. Heating the bias transfer roll results in a decrease in resistivity thereof which results in extended electrical life of the bias transfer roll in an electrophotographic printing apparatus.

It is therefore evident that there has been provided, in accordance with the present invention, an electrophotographic printing apparatus that fully satisfies the aims and advantages of the invention as hereinabove set forth. While this invention has been described in conjunction with preferred embodiments thereof, it is evident that many alternatives, modifications, and variations will be apparent to those skilled in the art. Accordingly, the present application for patent is intended to embrace all such alternatives, modifications and variations as are within the broad scope and spirit of the appended claims.

I claim:

1. An apparatus for extending electrical life in a transfer system for transferring electrically charged particles from an image support surface to a copy substrate, comprising:

a transfer member positioned adjacent to the image support surface;

means, coupled to said transfer member, for applying an electrical bias thereto so as to generate electric fields between said transfer member and the image support surface for transferring the charged particles from the image support surface to the copy substrate;

means for maintaining said transfer member at a substantially constant resistivity, said maintaining means comprising means for heating said transfer member to maintain said transfer member at a selected temperature, wherein said heating means includes:

a heating element internal to said transfer member; and a voltage source coupled to said heating element for applying a voltage potential thereacross; and means, including a voltage measuring device coupled across said electrical biasing means, for selectively activating said heating means in response to a predetermined voltage across said electrical biasing means.

2. The apparatus according to claim 1, further comprising means for detecting the temperature of said transfer member, said heating means being responsive to the detected temperature.

3. The transfer apparatus of claim 2, wherein said detecting means includes switching means, coupling said heating element and said voltage source to one another for selectively applying a voltage potential across said heating element.

4. The transfer apparatus of claim 3, wherein said detecting means includes a thermocoupled device coupled to said transfer member for activating said switching means in response to said transfer member being at the detected temperature.

5. The transfer apparatus of claim 1, wherein said biasing means includes a constant current source for providing a constant current through said transfer member to generate electric fields between said image support surface and said transfer member.

6. The transfer apparatus of claim 1, wherein said transfer member includes a transfer roll having an electrically conductive core member and a first layer of resistive material surrounding said electrically conductive core member.

7. The transfer apparatus of claim 6, wherein said transfer member further includes a second layer of resistive material surrounding said first layer of resistive material.

8. An electrostatographic printing apparatus including an apparatus for extending electrical life in a transfer system for transferring toner particles from an image support surface to a copy substrate, said transfer system comprising;

a transfer member positioned adjacent the image support surface;

means, coupled to said transfer member for applying an electrical bias thereto to generate electrical fields between said transfer member and the image support surface, for transferring the charged particles from the image support surface to the copy substrate;

means for maintaining said transfer member at a substantially constant resistivity, said maintaining means comprising means for heating said transfer member to maintain said transfer member at a selected temperature, wherein said heating means includes:

a heating element internal to said transfer member; and a voltage source coupled to said heating element for applying a voltage potential thereacross; and means, including a voltage measuring device coupled across said electrical biasing means, for selectively activating said heating means in response to a predetermined voltage across said electrical biasing means.

9. The electrostatographic printing apparatus of claim 8, further comprising means for detecting the temperature of said transfer member, said heating means being responsive to the detected temperature.

10. The electrostatographic printing apparatus of claim 9, wherein said detecting means includes switching means for coupling said heating element and said voltage source to one another to selectively apply a voltage potential across said heating element.

11. The electrostatographic printing apparatus of claim 10, wherein said detecting means includes a thermocouple device coupled to said transfer member for activating said switching means in response to said transfer member being at a predetermined temperature.

12. The electrostatographic printing apparatus of claim 8, wherein said biasing means includes a constant current source for providing a constant current through said transfer member to generate electric fields between said image support surface and said transfer member.

13. The electrostatographic printing apparatus of claim 8, wherein said transfer member includes a transfer roll having an electrically conductive core member and a first layer of resistive material surrounding said electrically conductive core member.

14. The electrostatographic apparatus of claim 13, wherein said transfer member further includes a second layer of resistive material surrounding said first layer of resistive material.

* * * * *